US010566704B2

(12) United States Patent
Kawaguchi et al.

(10) Patent No.: US 10,566,704 B2
(45) Date of Patent: Feb. 18, 2020

(54) ANTENNA APPARATUS AND SURFACE CURRENT SUPPRESSION FILTER FOR ANTENNA APPARATUS

(71) Applicant: DENSO CORPORATION, Kariya, Aichi-pref. (JP)

(72) Inventors: Kazushi Kawaguchi, Nishio (JP); Asahi Kondo, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 148 days.

(21) Appl. No.: 15/501,969

(22) PCT Filed: Jul. 14, 2015

(86) PCT No.: PCT/JP2015/070091
§ 371 (c)(1),
(2) Date: Feb. 6, 2017

(87) PCT Pub. No.: WO2016/021372
PCT Pub. Date: Feb. 11, 2016

(65) Prior Publication Data

US 2017/0244174 A1 Aug. 24, 2017

(30) Foreign Application Priority Data

Aug. 8, 2014 (JP) ..... 2014-162610

(51) Int. Cl.
*H01Q 15/00* (2006.01)
*H01Q 21/06* (2006.01)
*H01Q 15/14* (2006.01)

(52) U.S. Cl.
CPC ..... *H01Q 21/065* (2013.01); *H01Q 15/14* (2013.01); *H01Q 21/068* (2013.01)

(58) Field of Classification Search
CPC ..... H01Q 15/0006; H01Q 15/0013; H01Q 15/0046; H01Q 15/006; H01Q 15/008;
(Continued)

(56) References Cited

U.S. PATENT DOCUMENTS 6,262,495 B1 7/2001 Yablonovitch et al.
7,215,007 B2 * 5/2007 McKinzie, III ..... H01P 1/16 257/664

(Continued)

FOREIGN PATENT DOCUMENTS

JP 2010-199881 A 9/2010

OTHER PUBLICATIONS

Fan Yang et al., "Step-like structure and EBG structure to improve the performance of patch antennas on high dielectric substrate", IEEE Antennas and Propagation Society International Symposium 2001, 2001, pp. 482-485.

(Continued)

*Primary Examiner* — Daniel Munoz
*Assistant Examiner* — Patrick R Holecek
(74) *Attorney, Agent, or Firm* — Knobbe, Martens, Olson & Bear, LLP

(57) ABSTRACT

A surface current suppression filter (1) is a bandstop filter that suppresses propagation of a surface current in a predetermined propagation direction on a dielectric substrate (2). The filter (1) is configured such that a plurality of electromagnetic band gap (EBG) rows (10, 20) are arrayed in an array direction. Each EBG row (10, 20) has at least one EBG (11, 21) that is arrayed in a perpendicular direction orthogonal to the array direction. Cutoff characteristics of a first EBG (11) in the first EBG row (10) differs from cutoff characteristics of a second EBG (12) in the second EBG row (20).

6 Claims, 12 Drawing Sheets

(58) Field of Classification Search
CPC .... H01Q 15/14; H01Q 9/0407; H01Q 21/065; H01Q 21/068
See application file for complete search history.

(56) References Cited

U.S. PATENT DOCUMENTS

| | | | | |
|---|---|---|---|---|
| 7,847,737 | B2 * | 12/2010 | Kuroda | H01Q 9/0407 343/700 MS |
| 2010/0039343 | A1 * | 2/2010 | Uno | H01Q 3/24 343/818 |
| 2010/0214178 | A1 | 8/2010 | Toyao et al. | |
| 2012/0325523 | A1 * | 12/2012 | Kobayashi | H01Q 15/008 174/251 |
| 2014/0091879 | A1 | 4/2014 | Toyao et al. | |
| 2014/0152520 | A1 | 6/2014 | Toyao et al. | |

OTHER PUBLICATIONS

L.Liang et al., "A novel broadband EBG using multi-period mushroom-like structure", Microwave and Millimeter Wave Technology, 2008. ICMMT 2008. International Conference on, vol. 4, 2008, pp. 1609-1612.

Wenquan Cao et al., "Multi-Frequency and Dual-Mode Patch Antenna Based on Electromagnetic Band-gap (EBG) Structure", IEEE Transactions on Antennas and Propagation, vol. 60, No. 12, Aug. 3, 2012, pp. 6007-6012.

* cited by examiner (a) CROSS-SECTION A-A (b) CROSS-SECTION B-B (c) CROSS-SECTION C-C (a) COMPARATIVE STRUCTURE (b) STRUCTURE ACCORDING TO FIRST EMBODIMENT (CHANGES IN LINE LENGTH)

CROSS-SECTION D-D (a) ANTENNA APPARATUS IN WHICH FILTER HAVING COMPARATIVE STRUCTURE IS MOUNTED (b) ANTENNA APPARATUS IN WHICH FILTER ACCORDING TO FIRST EMBODIMENT IS MOUNTED

ANTENNA APPARATUS AND SURFACE CURRENT SUPPRESSION FILTER FOR ANTENNA APPARATUS

This application is a U.S. National Phase Application under 35 U.S.C. 371 of International Application No. PCT/JP2015/070091 filed on Jul. 14, 2015 and published in Japanese as WO 2016/021372 A1 on Feb. 11, 2016. This application is based on and claims the benefit of priority from Japanese Patent Application No. 2014-162610, filed Aug. 8, 2014. The entire disclosures of all of the above applications are incorporated herein by reference.

TECHNICAL FIELD

The present invention relates to an antenna apparatus that is mounted in a moving body, such as a vehicle or an aircraft, and a surface current suppression filter provided in the apparatus. In particular, the present invention relates to an antenna apparatus that includes a substrate composed of a dielectric material and a patch antenna set on the substrate, and a surface current suppression filter that is provided in the antenna apparatus and includes a circuit that suppresses a surface current that propagates over the substrate.

BACKGROUND ART

In a moving body such as a vehicle or an aircraft, for example, an antenna apparatus in which a patch antenna is mounted as one of the antennas for a radar that monitors the surroundings is used. This antenna apparatus includes a dielectric substrate and a patch antenna formed on the substrate. The patch antenna typically has a configuration in which a patch radiating element (patch-shaped conductor) is formed on the dielectric substrate. In addition, a conductor portion is typically formed on a surface of the dielectric substrate on the side opposite the surface on which the patch radiating element is formed. The conductor portion functions as a ground plane. The surface of the dielectric substrate on which the patch radiating element is formed is hereinafter referred to as a substrate front surface. The surface of the dielectric substrate on the side opposite the surface on which the patch radiating element is formed is hereinafter referred to as a substrate back surface. Furthermore, a conductor portion may also be widely formed on the substrate front surface as well, so as to reach a substrate end portion, separately from the patch radiating element.

In a patch antenna configured in such a manner, when the patch antenna is operated, a current (surface current) flows to the ground plane surface as a result of an electric field formed between the patch radiating element and the ground plane. Furthermore, the surface current is transmitted to the substrate end portion and is diffracted at the substrate end portion. In addition, emission (radiation) from the substrate end portion occurs due to the effects of the diffraction wave. When the conductor portion is formed on the substrate front surface, the surface current also flows to the conductor portion and causes emission from the substrate end portion. The emission from the substrate end portion caused by the surface current becomes unnecessary emission that affects performance of the patch antenna. That is, directivity of the patch antenna becomes disturbed as a result of the emission from the end portion.

In regard to the foregoing, a technology for suppressing the surface current flowing to the ground plane is disclosed in PTL 1. Specifically, a plurality of conductive patches are formed in the periphery of the patch radiating element on the substrate front surface of the dielectric substrate. Each conductive patch is connected in a conductive manner to the ground plane on the substrate back surface by a conductive connecting body (hereinafter referred to as a conductive via) having a circular columnar shape. The structure composed of the conductive patch and the conductive via has a band gap (electromagnetic band gap) that inhibits propagation of the surface current on the ground plane at a specific frequency. The structure composed of the conductive patch and the conductive via is hereinafter referred to as an electromagnetic band gap (EBG).

As a result of numerous EBGs being formed in the periphery of the patch radiating element as described above, propagation of surface current to the substrate end portion can be suppressed. Therefore, disturbance in the directivity of the patch antenna can be suppressed

CITATION LIST

Patent Literature

[PTL 1] JP-A-2002-510886

SUMMARY OF INVENTION

Technical Problem

However, the stopband of the EBG is narrow. Therefore, the frequency band over which the surface current propagated to the surface end portion (and radiation from the substrate end portion) can be suppressed is narrow. That is, of the surface current propagated to the substrate end portion, the frequency band that can be cut off by the EBG is limited to a narrow range. Consequently, the effect of suppressing the surface current is insufficient in the technology described in PTL 1. Further improvement in the suppression effect is desired.

The present invention has been achieved in light of the above-described issue. In addition, an object of the present invention is to provide a surface current suppression filter that is capable of more effectively blocking propagation of a surface current on a dielectric substrate and to provide an antenna apparatus that is capable of effectively suppressing disturbance in directivity caused by the surface current.

Solution to Problem

A surface current suppression filter of the present invention is a bandstop filter that suppresses propagation of a surface current in a predetermined propagation direction on a dielectric substrate in which a conductor plate is formed on one plate surface. In addition, the surface current suppression filter of the present invention includes a plurality of conductive structures provided on the dielectric substrate.

Each conductive structure has a patch conductor portion and a connecting conductor. The patch conductor portion is a patch-shaped conductor formed on the other plate surface of the dielectric substrate. The connecting conductor is formed between the patch conductor portion and the conductor plate so as to pass through the dielectric substrate to electrically connect the patch conductor portion and the conductor plate.

The surface current suppression filter is configured such that a plurality of structure rows are arrayed in the propagation direction, each of the plurality of structure rows including at least one conductive structure arrayed in a perpendicular direction orthogonal to the propagation direction. In addition, cutoff characteristics of the surface current of the conductive structure in at least one structure row of the plurality of structure rows differs from cutoff characteristics of the surface current of the conductive structure in at least one other structure row of the plurality of structure rows.

As described above, the surface current suppression filter configured is configured such that cutoff characteristics of the conductive structure in at least one structure row of the plurality of structure rows arrayed in the propagation direction differ from cutoff characteristics of the conductive structure in at least one other structure row of the plurality of structure rows. As a result of the configuration such as that described above, of the surface current that propagates on the dielectric substrate, a frequency component that can be suppressed by at least one of the plurality of types of structure rows having differing cutoff characteristics can be suppressed by the structure row. As the types of structure rows having differing cutoff characteristics increases, the frequency band that can be suppressed can also be widened. Therefore, propagation of surface current over the dielectric substrate can be effectively blocked.

In addition, an antenna apparatus of the present invention includes a dielectric substrate, a patch antenna, and a surface current suppression filter. In the dielectric substrate, a ground plane is formed on one plate surface. The patch antenna has at least one patch radiating element for power supply formed on the other plate surface of the dielectric substrate. In addition, the patch antenna is an antenna of which a predetermined direction on the plate surface of the dielectric substrate is a main polarization direction. The surface current suppression filter is provided between at least one end portion of both end portions of the dielectric substrate in the main polarization direction and the patch antenna. In addition, the surface current suppression filter is a bandstop filter that suppresses propagation of a surface current from the patch antenna to the end portion on the dielectric substrate.

More specifically, the surface current suppression filter includes a plurality of conductive structures provided on the dielectric substrate. Each conductive structure includes a patch conductor portion and a connecting conductor. The patch conductor portion is a patch-shaped conductor formed on the other plate surface of the dielectric substrate. The connecting conductor is a conductor that is formed between the patch conductor portion and the ground plane so as to pass through the dielectric substrate to electrically connect the patch conductor portion and the ground plane.

The surface current suppression filter is configured such that a plurality of structure rows are arrayed in the main polarization direction, each of the plurality of structure rows including at least one conductive structure arrayed in a perpendicular direction orthogonal to the main polarization direction. Cutoff characteristics of the surface current of the conductive structure in at least one structure row of the plurality of structure rows differs from cutoff characteristics of the surface current of the conductive structure in at least one other structure row of the plurality of structure rows.

In the antenna apparatus configured as described above, a surface current may flow from the patch antenna to both substrate ends on the dielectric substrate, as a result of radiation from the patch antenna. Therefore, in the antenna apparatus of the above-described configuration, the surface current suppression filter is provided between at least either of both substrate ends and the patch antenna. As a result of the foregoing, at least the surface current to the substrate end portion on the side on which the surface current suppression filter is provided is suppressed by the surface current suppression filter. Furthermore, the surface current suppression filter has at least two types of conductive structures of which the cutoff characteristics differ. Therefore, disturbance in directivity of the patch antenna attributed to the surface current can be effectively suppressed.

Reference signs within the parentheses recited in the scope of claims indicate corresponding relationships with specific means described according to an embodiment described hereafter as an aspect, and do not limit the technical scope of the present invention.

BRIEF DESCRIPTION OF DRAWINGS

In the accompanying drawings:

FIG. 3 shows partial cross-sectional views of the surface current suppression filter according to the first embodiment, in which FIG. 3 shows, by (a), a cross-section taken along A-A, by (b) a cross-section taken along B-B, and, by (c) a cross-section taken along C-C;

FIG. 4 shows explanatory diagrams of equivalent circuits of the surface current suppression filter, in which FIG. 4 shows, by (a), an equivalent circuit of a surface current suppression filter having a comparative structure and, by (b), equivalent circuits of the surface current suppression filter according to the first embodiment;

DESCRIPTION OF EMBODIMENTS

Preferred embodiments of the present invention will hereinafter be described with reference to the drawings.

[First Embodiment]

An example of a surface current suppression filter of the present invention will be described in detail with reference to FIGS. 1 to 5.

Although described hereafter, the surface current suppression filter composes a portion of an antenna apparatus. The antenna apparatus is described in detail according to a third embodiment. The antenna apparatus includes a dielectric substrate 2 and a ground plane 3 (see FIG. 9). The dielectric substrate 2 is formed by a dielectric material. The ground plane 3 is formed on one surface of the substrate (substrate back surface). The surface current suppression filter according to the present embodiment is also mounted on the dielectric substrate 2 and the ground plane 3.

Figure 1:
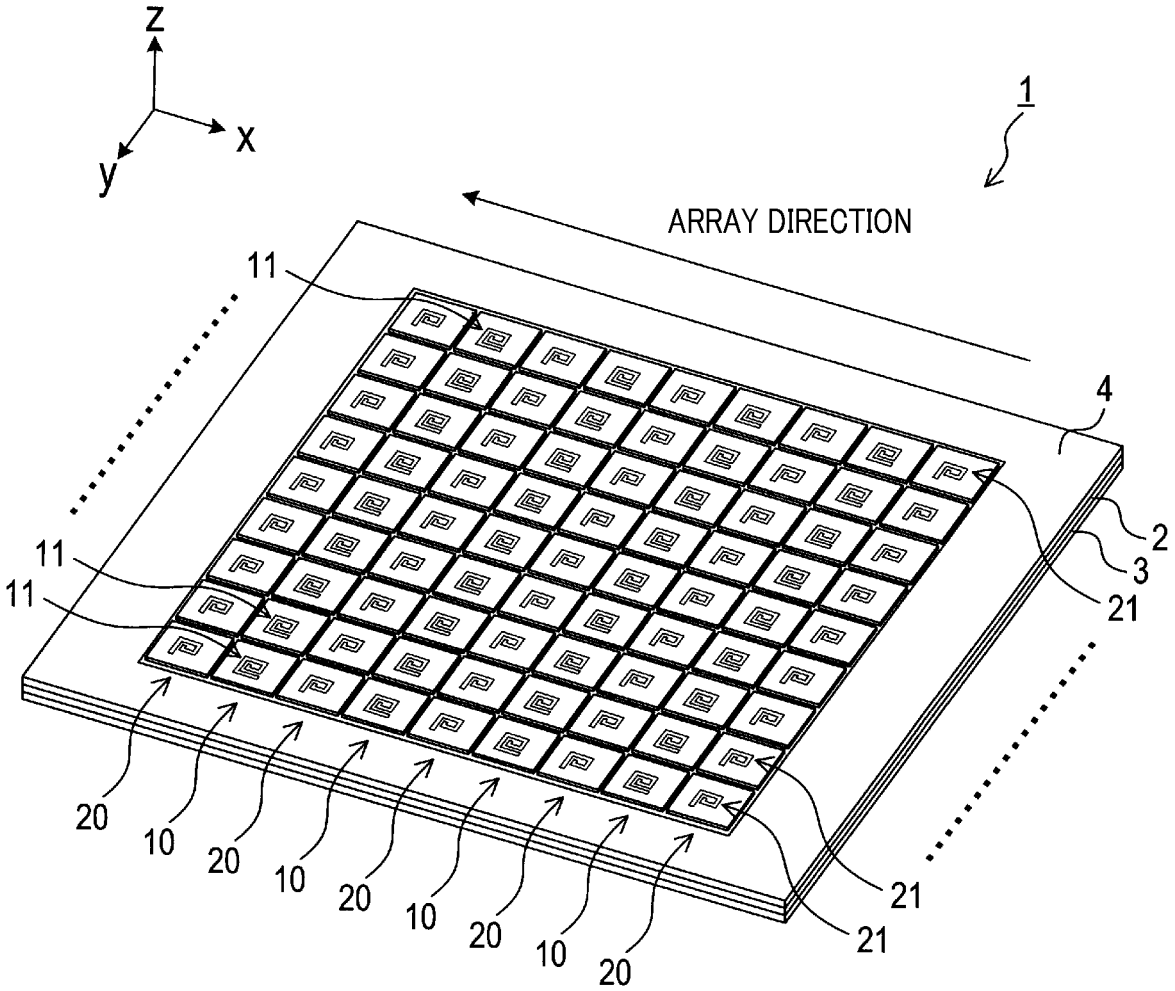
FIG. 1 is a perspective view of a surface current suppression filter according to a first embodiment.

A surface current suppression filter 1 according to the present embodiment is shown in FIG. 1. As shown in FIG. 1, in the filter 1, the ground plane 3 is provided on one surface (substrate back surface) of the dielectric substrate 2. The ground plane 3 is composed of a conductor. The dielectric substrate 2 has a rectangular shape. A conductor plate 4 and a plurality of electromagnetic band gaps (EBGs) (a plurality of first EBGs 11 and a plurality of second EBGs 21) are formed on the other surface (substrate front surface) of the dielectric substrate 2. As shown in FIG. 1, the surface current suppression filter 1 is configured to share the dielectric substrate 2 and the ground plane 3 of the antenna apparatus.

According to the present embodiment, as shown in FIG. 1, the description will be given using, as appropriate, xyz three-dimensional coordinate axes in which an axis parallel to a long side of the dielectric substrate 2 is an x axis, an axis parallel to a short side of the dielectric substrate 2 is a y axis, and an axis perpendicular to the plate surface of the dielectric substrate 2 is a z axis.

The conductor plate 4, which has a rectangular ring shape, is formed in an outer peripheral portion on the substrate front surface of the dielectric substrate 2. The plurality of EBGs 11 and 21 are formed in an area in which the conductor plate 4 is not formed on the substrate front surface of the dielectric substrate 2. However, as is also clear from FIG. 2 and FIG. 3, the EBGs 11 and 21 and the conductor plate 4 are in a physically separated state. Therefore, the EBGs 11 and EBGs 21 are also physically separated from each other. In other words, grooves in which the conductor plate is not present (the dielectric substrate 2 is exposed) are formed between the EBGs and between the EBGs and the conductor plate 4. The width of the groove is expressed by reference sign wg, according to the present embodiment.

The arrangement of the plurality of EBGs 11 and 21 will be described in detail. In the surface current suppression filter 1 according to the present embodiment, a plurality of EBG rows 10 and 20 are arrayed in a predetermined array direction (x-axis direction according to the present embodiment). Specifically, as shown in FIGS. 1 to 3, the first EBG rows 10 and the second EBG rows 20 are alternately arrayed in the array direction (x-axis direction) in a manner such as second EBG row 20, first EBG row 10, second EBG row 20, first EBG row 10, second EBG row 20, . . . .

The first EBG row 10 has a plurality (nine according to the present embodiment) of first EBGs 11. More specifically, the plurality of first EBGs 11 are configured so as to be arrayed in a direction (y-axis direction) perpendicular to the above-described array direction. The second EBG row 20 has a plurality (nine according to the present embodiment) of second EBGs 21. More specifically, the plurality of second EBGs 21 are configured so as to be arrayed in the y-axis direction.

Figure 2:
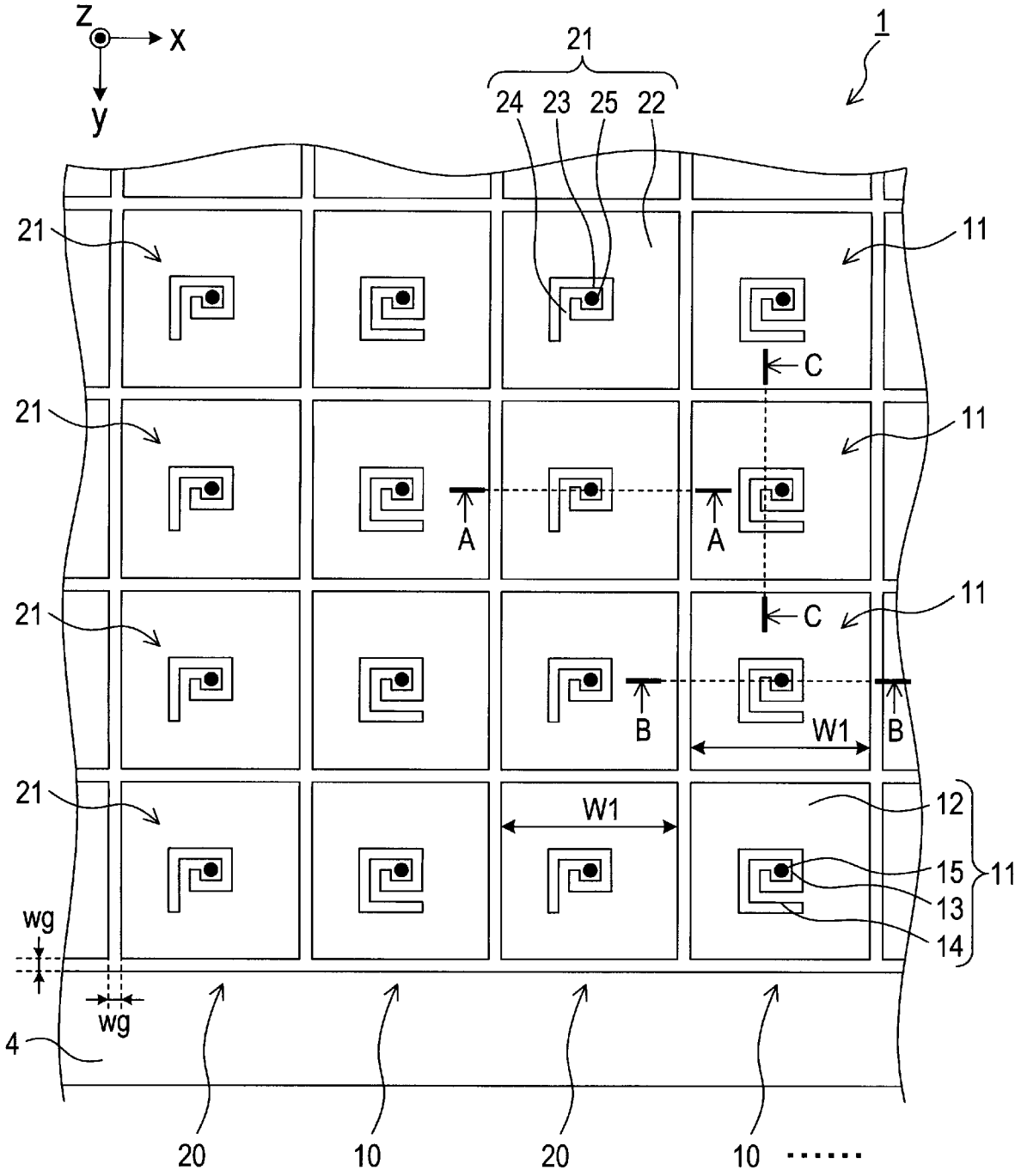
FIG. 2 is a partial top view of the surface current suppression filter according to the first embodiment.
Figure 3:
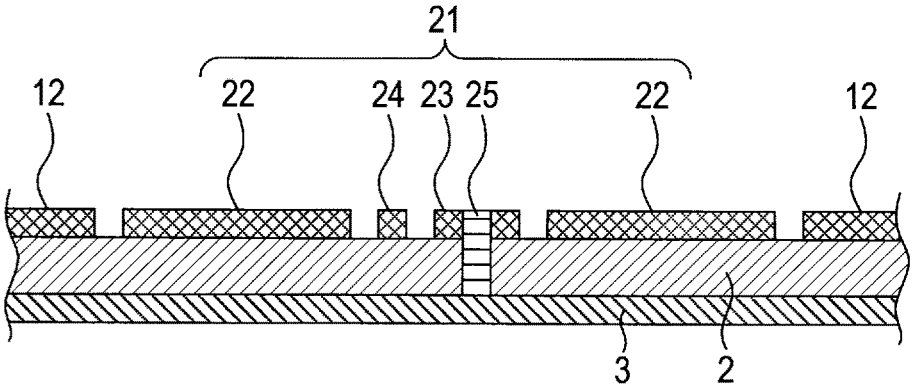
Figure 3:
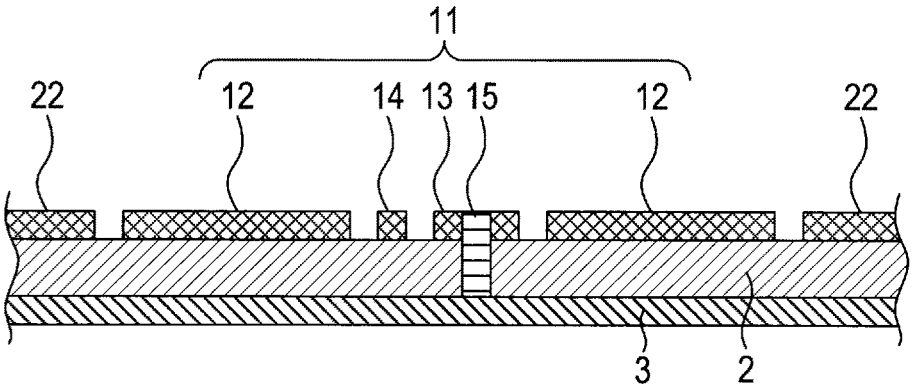
Figure 3:
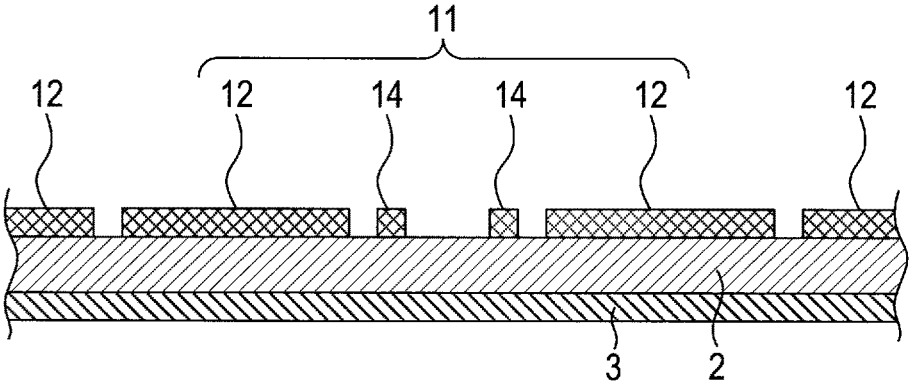

As shown in FIG. 2, FIG. 3 by (b), and FIG. 3 by (c), the first EBG 11 has a first patch-shaped pattern 12, a connecting portion 13, a first linear pattern 14, and a conductive via 15.

The first patch-shaped pattern 12 is a conductor pattern that has a rectangular annular shape and a patch shape. The first patch-shaped pattern 12 is formed on the substrate front surface of the dielectric substrate 2. An outer peripheral shape of the first patch-shaped pattern 12 is a square. According to the present embodiment, the first patch-shaped pattern 12, as a whole, has the rectangular annular shape, as a result of the interior of a square being cut out. The length of one side of the square is reference sign W1.

The connecting portion 13 is a micro conductor pattern formed in a substantially central portion of an inner area (area in which a conductor pattern is not present) of the first patch-shaped pattern 12 (also a substantially central portion of the overall first EBG 11).

The conductive via 15 is a conductor having a circular columnar shape that is used to physically and electrically connect the connecting portion 13 and the ground plane 3. As shown in FIG. 3 by (b), the conductive via 15 is provided so as to pass through the dielectric substrate 2 in a direction (z-axis direction) perpendicular to the plate surface thereof. One end side (substrate front surface side) of the conductive via 15 is connected to the connecting portion 13 and the other end side (substrate back surface side) is connected to the ground plane 3.

The first linear pattern 14 is a linearly shaped conductor pattern that connects the connecting portion 13 and the first patch-shaped pattern 12. The first patch-shaped pattern 12 and the conductive via 15 are electrically connected by the first linear pattern 14.

As shown in FIG. 2 and FIG. 3 by (a), the second EBG 21 includes a second patch-shaped pattern 22, a connecting portion 23, a second linear pattern 24, and a conductive via 25.

In a manner similar to the first patch-shaped pattern 12, the second patch-shaped pattern 22 is a conductor pattern that has a rectangular annular shape and a patch shape. In addition, the second patch-shaped pattern 22 is formed on the substrate front surface of the dielectric substrate 2. In a manner similar to the first patch-shaped pattern 12, the second patch-shaped pattern 22, as a whole, has the rectangular annular shape, as a result of the interior of a square being cut out. The length of one side of the square is reference sign W1.

The connecting portion 23 is a micro conductor pattern formed in a substantially central portion of an inner area (area in which a conductor pattern is not present) of the second patch-shaped pattern 22 (also a substantially central portion of the overall second EBG 21).

The conductive via 25 is a conductor having a circular columnar shape that is used to physically and electrically connect the connecting portion 23 and the ground plane 3. As shown in FIG. 3 by (a), the conductive via 25 is provided so as to pass through the dielectric substrate 2 in a direction (z-axis direction) perpendicular to the plate surface thereof. One end side (substrate front surface side) of the conductive via 25 is connected to the connecting portion 23 and the other end side (substrate back surface side) is connected to the ground plane 3.

The second linear pattern 24 is a linearly shaped conductor pattern that connects the connecting portion 23 and the second patch-shaped pattern 22. The second patch-shaped pattern 22 and the conductive via 25 are electrically connected by the second linear pattern 24.

The first EBG 11 and the second EBG 21 have similar configurations for the most part. However, the greatest difference between the two is the lengths of the linear patterns 14 and 24. According to the present embodiment, as is clear from FIG. 2, the length of the first linear pattern 14 of the first EBG 11 is longer than the length of the second linear pattern 24 of the second EBG 21. The difference in length between the linear patterns 14 and 24 manifests as a difference in operation characteristics between the EBGs 11 and 21 (specifically, a difference in cutoff characteristics, described hereafter).

The first EBG 11 and the second EBG 21 both function as a bandstop filter for inhibiting a surface current that propagates over the dielectric substrate 2. When a center frequency of the surface current to be cut off is fa, reference sign W1 that is the length of one side of each of the patch-shaped patterns 12 and 22 configuring the EBGs 11 and 21 is about λg/2. Here, λg is a wavelength (a dielectric material inner wavelength) corresponding to the center frequency fa of the surface current. In addition, when a free space wavelength is λ0 and a dielectric constant of the dielectric substrate 2 is εr, λg is expressed as λg=λ0/√εr. However, reference sign W1 being about λg/2 is merely an example.

The EBGs 11 and 21 each also realize functions as a filter even as single units. However, according to the present embodiment, the EBGs 11 and 21 have enhanced functions as a filter as a result of the plurality of EBGs being arrayed. Furthermore, according to the present embodiment, the functions as a filter are further enhanced as a result of the first EBGs 11 and the second EBGs 21, having differing cutoff characteristics, being alternately arrayed in the array direction. As a result, the function as a filter is further enhanced. Specifically, as already described, the first EBG rows 10 composed of the plurality of first EBGs 11 arrayed in the y-axis direction and the second EBG rows 20 composed of the plurality of second EBGs 21 arrayed in the y-axis direction are alternately arrayed in the array direction. As a result, compared to a case in which only the first EBG rows 10 are arrayed or only the second EBG rows 20 are arrayed, high cutoff characteristics are achieved as a whole. Specifically, a filter having a wide frequency band (stopband) that can be cut off regarding the surface current propagating in the array direction can be actualized. That is, the surface current suppression filter 1 according to the present embodiment is configured as a filter that is capable of effectively suppressing, in particular, the surface current that propagates in the array direction. Consequently, the surface current suppression filter 1 according to the present embodiment is capable of realizing favorable functions by being used in such applications.

Each of the EBGs 11 and 21 is capacitively coupled with other EBGs adjacent in the array direction. In addition, each of the EBGs 11 and 21 is also inductively and capacitively coupled with the ground plane 3 on the substrate back surface. As a result, the EBGs 11 and 21, as a whole, function as a two-dimensional circuit network of parallel-resonant circuits. The EBGs 11 and 21 suppress propagation of the surface current in the array direction.

Figure 4:
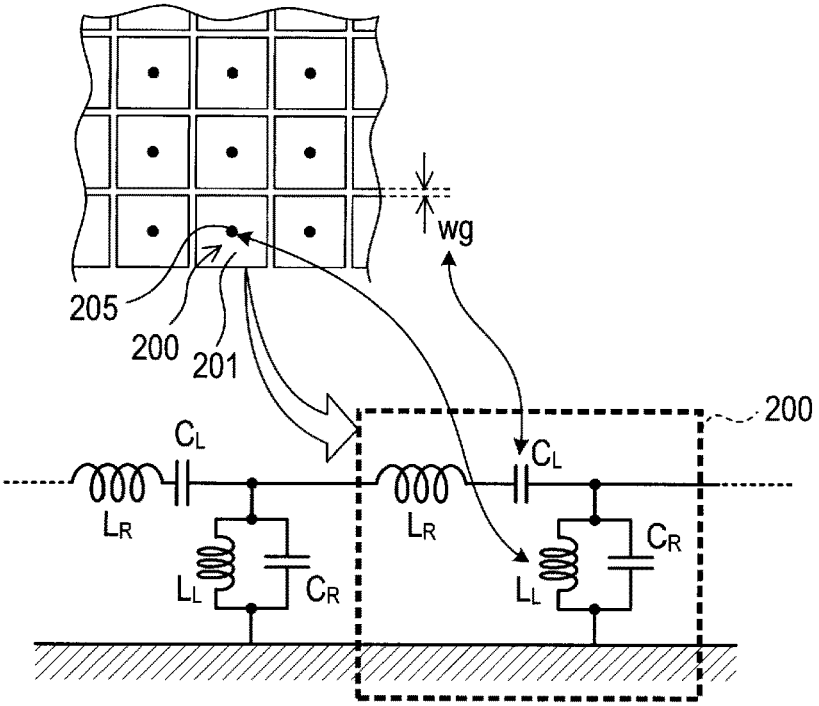
Figure 4:
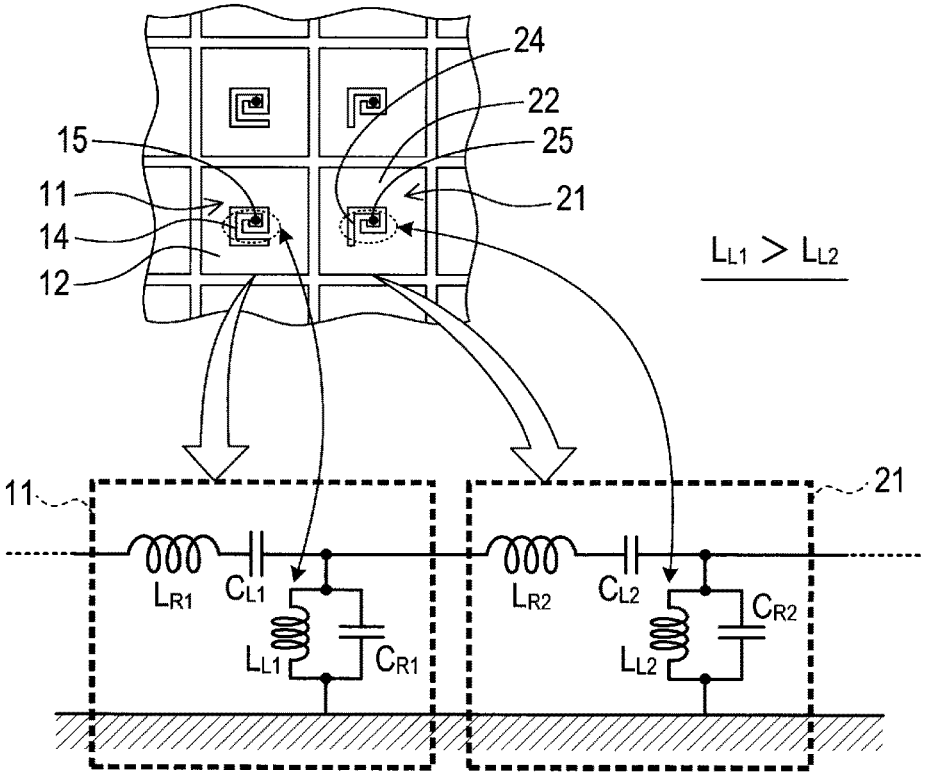

Equivalent circuits of the EBGs 11 and 21 according to the present embodiment are as shown in FIG. 4 by (b). In FIG. 4 by (a), an equivalent circuit of an EBG (comparative EBG) 200 in which a plurality of EBGs of a single type are arrayed is shown for comparison.

As shown in FIG. by 4(*a*), the comparative EBG 200 has a patch-shaped pattern 201 and a conductive via 205. In the comparative EBG 200, a capacitance component (capacitance) $C_L$ is present as a result of the comparative EBG 200 being capacitively coupled with another adjacent comparative EBG 200 with a pattern spacing wg therebetween. In addition, an inductance component (inductance) $L_R$ is present as a result of the patch-shaped pattern 201, and an inductance component $L_L$ is present between the patch-shaped pattern 201 and the ground plane 3 as a result of the conductive via 205. Furthermore, a capacitance component $C_R$ is present between the patch-shaped pattern 201 and the ground plane 3 in parallel to the inductance component $L_L$. Therefore, the equivalent circuit of the comparative EBG 200 is an LC resonant circuit such as that shown in FIG. 4 by (a).

Consequently, a cutoff center frequency fc0 (that is, a resonance frequency of the above-described LC resonant circuit) of the filter actualized by the comparative EBG 200 can be expressed by following expression (1).

[Formula 1]

$$fc0 = \frac{1}{2\pi\sqrt{L_L C_R}} \tag{1}$$

Meanwhile, the shape of the conductors on the substrate front surface significantly differs in the EBGs 11 and 21 according to the present embodiment, compared to that of the comparative EBG 200. In addition, the lengths of the linear patterns 14 and 24 mainly differ between the EBGs 11 and 21, as well. Therefore, the respective equivalent circuits of the EBGs 11 and 21 are circuits such as those shown in FIG. 4 by (b).

Consequently, a cutoff center frequency fc11 of the filter actualized by the first EBGs 11 and a cutoff center frequency fc12 of the filter actualized by the second EBGs 21 can be expressed by following expressions (2) and (3).

[Formula 2]

$$fc11 = \frac{1}{2\pi\sqrt{L_{L1} C_{R1}}} \tag{2}$$

$$fc12 = \frac{1}{2\pi\sqrt{L_{L2} C_{R2}}} \tag{3}$$

In the equivalent circuits of the EBGs 11 and 21 shown in FIG. 4 by (b), respective capacitance components $C_{L1}$ and $C_{L2}$ attributed to capacitive coupling with adjacent EBGs are substantially identical values. In addition, respective inductance components $L_{R1}$ and $L_{R2}$ attributed to the patch-shaped patterns 12 and 22 are also substantially identical values. Furthermore, respective capacitance components $C_{R1}$ and $C_{R2}$ present between the patch-shaped patterns 12 and 22 and the ground plane 3 are also substantially identical values.

Meanwhile, an inductance component $L_{L1}$ (hereinafter also referred to as a first inter-ground-plate inductance) present between the first patch-shaped pattern 12 and the ground plane 3 is generated by the conductive via 15 and the first linear pattern 14. In addition, an inductance component $L_{L2}$ (hereinafter also referred to as a second inter-ground-plate inductance) present between the second patch-shaped pattern 22 and the ground plane 3 is generated by the conductive via 25 and the second linear pattern 24. The length of the first linear pattern 14 and the length of the second linear pattern 24 differ. Therefore, the first inter-ground-plate inductance $L_{L1}$ and the second inter-ground-plate inductance $L_{L2}$ differ. Specifically, $L_{L1}>L_{L2}$.

Consequently, the first cutoff center frequency fc11 and the second cutoff center frequency fc12 also differ. The first cutoff center frequency fc11 is the cutoff center frequency (resonance frequency) of the first EBG 11. The second cutoff center frequency fc12 is the cutoff center frequency (resonance frequency) of the second EBG 21. That is, fc11<fc12. The differences in the cutoff characteristics between the EBGs 11 and 21 are mainly produced by the lengths of the linear patterns 14 and 24 configuring the EBGs 11 and 21 being set to differ.

Therefore, the cutoff center frequencies fc11 and fc12 of the EBGs 11 and 21 are appropriately set based on the center frequency fa of the surface current to be cut off. Then, the EBGs 11 and 21 are configured such that the cutoff center frequencies fc11 and fc12 that have been set are obtained. As a result, the surface current suppression filter 1 having a wide stopband can be actualized. That is, widening of the stopband is actualized by the array periodic structure in the array direction of the LC resonant structure determining the resonance frequency of the EBGs 11 and 21 being a dual resonance structure. According to the present embodiment, the stopband refers to a band of which pass gain is suppressed to −10 [dB] or lower.

Various setting methods can be considered regarding the values to which the cutoff center frequencies fc11 and fc12 are respectively set in relation to the center frequency fa of the surface current. For example, a method for setting the cutoff center frequencies fc11 and fc12 such that the stopband of the first EBG 11 and the stopband of the second EBG 21 are continuous can be considered. As a result of the stopbands of the first EBG 11 and the second EBG 21 being set to be continuous, a wide stopband (a band from the lower limit of the stopband of the first EBG 11 to the upper limit of the stopband of the second EBG 21) can be achieved, as a whole.

Figure 5:
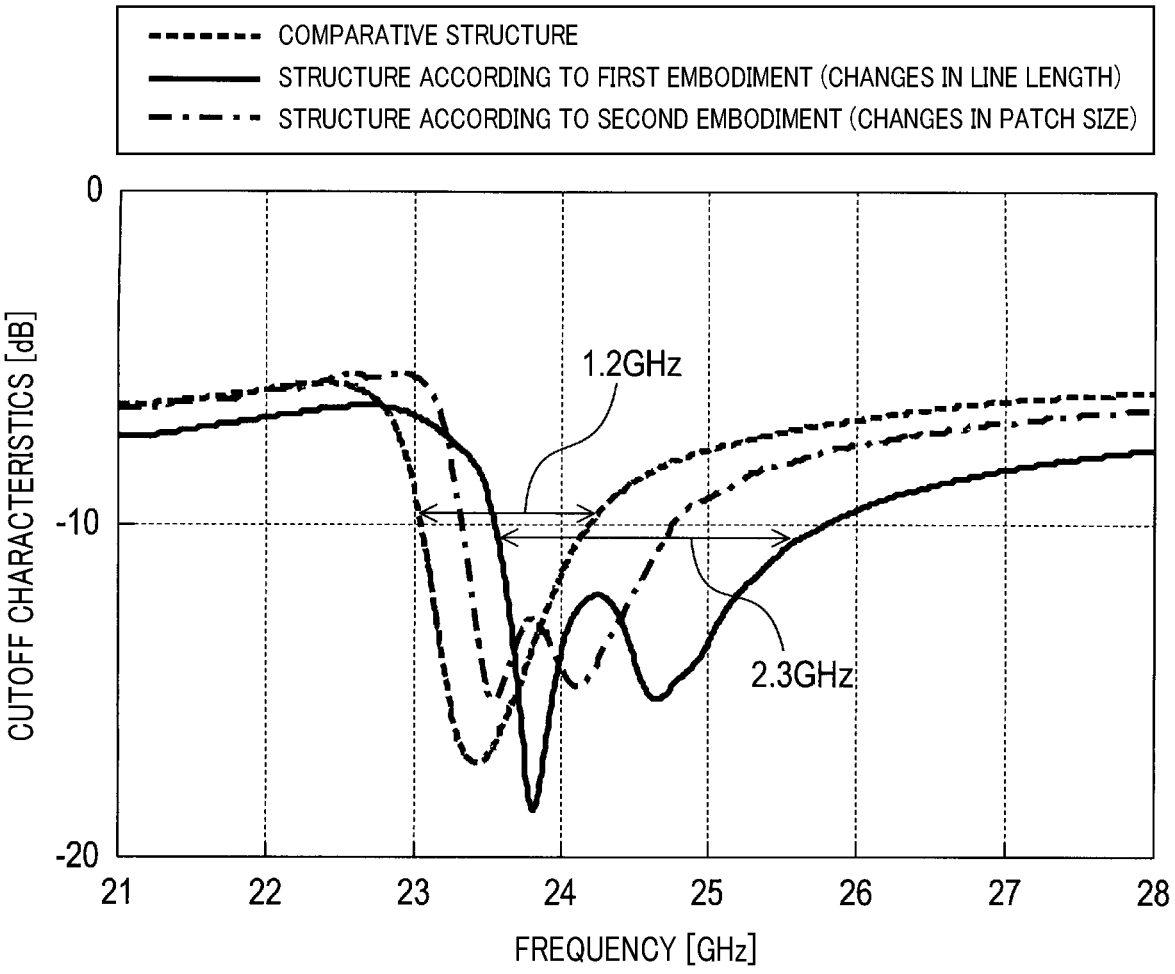
FIG. 5 is an explanatory diagram of cutoff characteristics of surface current suppression filters according to the first embodiment and a second embodiment, and that having the comparative structure.

Examples of the cutoff characteristics of the surface current suppression filter by the EBG 200 having the comparative structure shown in FIG. 4 by (a) and the cutoff characteristics of the surface current suppression filter 1 according to the present embodiment are shown in FIG. 5. As shown in the examples in FIG. 5, whereas the stopband of the surface current suppression filter having the comparative structure is a narrow band of about 1.2 GHz width, the stopband of the surface current suppression filter 1 according to the present embodiment is approximately 2.3 GHz wide.

For example, as a result of the length of the first linear pattern 14 of the first EBG 11 being set to about λg/4 and the length of the second linear pattern 24 of the second EBG 21 being set to about λg/8, the cutoff characteristics of the surface current suppression filter shown as an example in FIG. 5 (or characteristics similar thereto) can be achieved. The thicknesses of the linear patterns 14 and 24 can be appropriately determined. However, the thicknesses are preferably to an extent that the wavelength λg can be ignored. As a specific example, setting the thicknesses of the linear patterns 14 and 24 to both be about 150 μm, in relation to a 24 GHz band surface current can be considered.

In this way, as a result of two types of EBGs 11 and 21 having differing cutoff characteristics being alternately arrayed in the array direction, widening of the stopband can be achieved.

As described above, in the surface current suppression filter 1 according to the present embodiment, the plurality of the first EBGs 11 and the second EBGs 21 having differing cutoff characteristics (specifically, cutoff center frequencies) are alternately arrayed in the array direction (x-axis direction). More specifically, the first EBG rows 10 composed of the plurality of first EBGs 11 arrayed in the y-axis direction and the second EBG rows 20 composed of the plurality of second EBGs 21 arrayed in the y-axis direction are alternately arrayed in the array direction (x-axis direction).

As a result of a configuration such as this, the stopband of the surface current suppression filter 1 becomes a wide band in which the stopband of the first EBG 11 (a predetermined band including the first cutoff center frequency fc11) and the stopband of the second EBG 21 (a predetermined band including the second cutoff center frequency fc12) are combined. Therefore, propagation of the surface current over the dielectric substrate 2 (in particular, propagation in the array direction) can be effectively blocked.

In particular, according to the present embodiment, the first EBG rows 10 and the second EBG rows 20 are alternately arrayed, one by one. Therefore, cutoff effects can be achieved at an equal level from each of the first EBGs 11 and the second EBGs 21. Therefore, as a whole, the cutoff effects of the EBGs 11 and 21 can be achieved in a well-balanced manner.

In addition, according to the present embodiment, the difference in cutoff characteristics between the EBGS 11 and 21 is actualized by the shapes of the conductor portions formed on the substrate front surface being made to differ. Specifically, this means that the lengths of the linear patterns connecting the patch-shaped patterns and the conductive vias are made to differ. That is, the difference is actualized by a comparatively simple configuration. Therefore, a plurality of types (two types according to the present embodiment) of EBGs 11 and 21 having differing cutoff characteristics can be easily formed. Furthermore, the surface current suppression filter 1 can be easily and inexpensively obtained.

[Second Embodiment]

A surface current suppression filter 30 according to a second embodiment will be described with reference to FIGS. 6 to 8.

Here, in the surface current suppression filter 30 according to the present second embodiment, configurations that are shared with the surface current suppression filter 1 according to the first embodiment are given the same reference signs as those according to the first embodiment. Detailed descriptions thereof are omitted.

Figure 6:
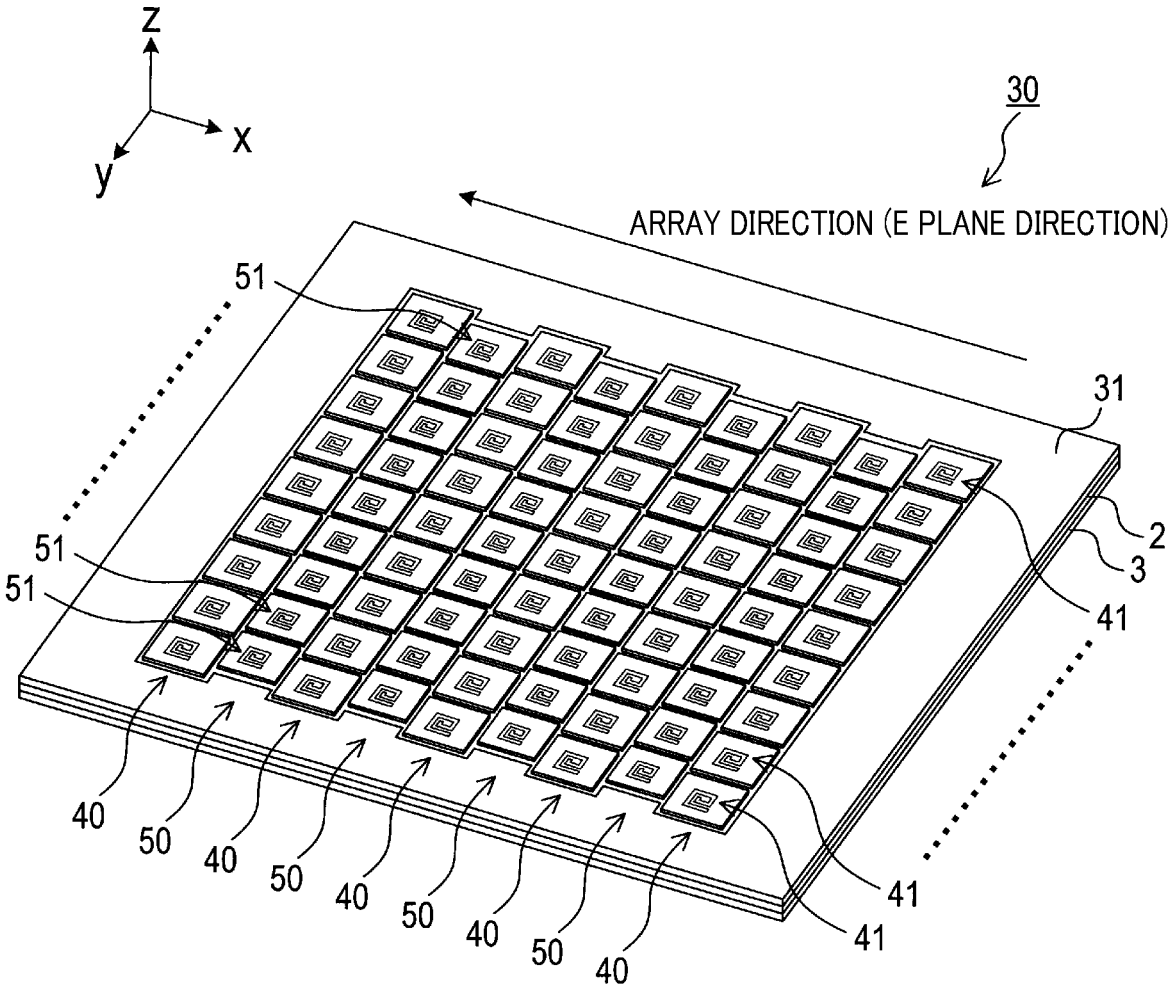
FIG. 6 is a perspective view of the surface current suppression filter according to the second embodiment.
Figure 7:
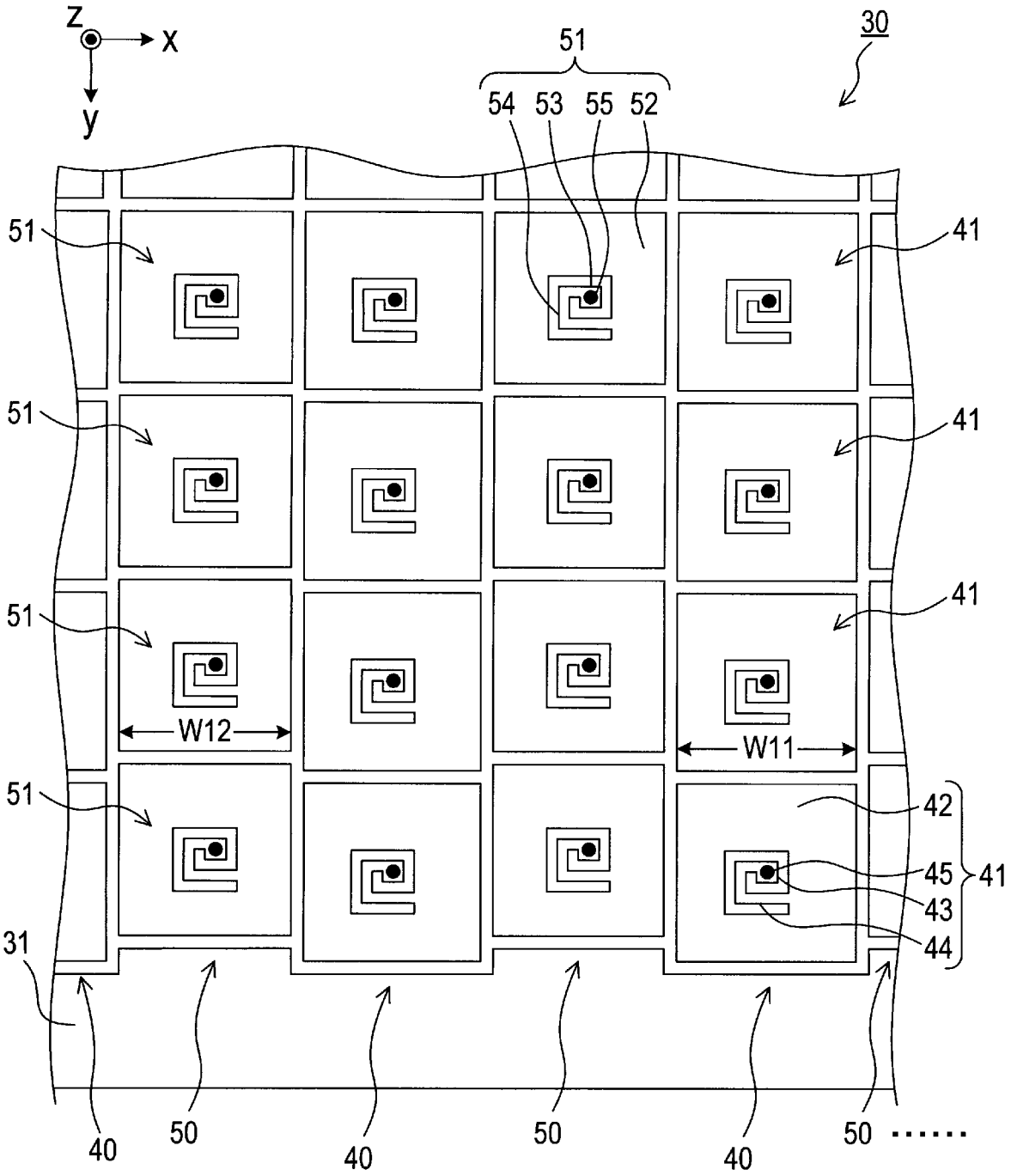
FIG. 7 is a partial top view of the surface current suppression filter according to the second embodiment.

As shown in FIGS. 6 and 7, in the surface current suppression filter 30 according to the present second embodiment, the ground plane 3 is formed on the substrate back surface of the dielectric substrate 2. The surface current suppression filter 30 according to the present second embodiment is configured by a conductor plate 31 and a plurality of EBGs (a plurality of first EBGs 41 and a plurality of second EBGs 51) being formed on the substrate front surface.

The conductor plate 31, which has a rectangular ring shape, is formed in an outer peripheral portion on the substrate front surface of the dielectric substrate 2. T In addition, the plurality of EBGs 41 and 51 are formed in an area in which the conductor plate 31 is not formed on the substrate front surface of the dielectric substrate 2. The EBGs 41 and 51 and the conductor plate 31 are in a physically separated state. The EBGs 41 and 51 are also physically separated from each other. That is, grooves are formed between the EBGs and between the EBGs and the conductor plate 31 in a manner similar to that according to the first embodiment.

The arrangement of the plurality of EBGs 41 and 51 will be described in detail. In the surface current suppression filter 30 according to the present embodiment, a plurality of EBG rows 40 and 50 are arrayed in a predetermined array direction (x-axis direction). Specifically, as shown in FIG. 6 and FIG. 7, the first EBG rows 40 and the second EBG rows 50 are alternately arrayed in the array direction (x-axis direction).

The first EBG row 40 is configured by a plurality (eight according to the present embodiment) of first EBG rows 41 arrayed in the y-axis direction. The second EBG row 50 is configured by a plurality (eight according to the present embodiment) of second EBGs 51 arrayed in the y-axis direction.

As shown in FIG. 7, the first EBG 41 has a first patch-shaped pattern 42, a connecting portion 43, a linear pattern 44, and a conductive via 45. According to the present embodiment, the first EBG 41 is completely identical in shape and size to the first EBG 11 according to the first embodiment. Therefore, reference sign W11, that is, the length of one side of the first patch-shaped pattern 42 that has a square shape is the same as reference sign W1, that is, the length of one side of the first patch-shaped pattern 12 of the first EBG 11 according to the first embodiment. Therefore, a first cutoff center frequency fc21 and the stopband of the first EBG 41 is substantially the same as those of the first EBG 11 according to the first embodiment.

Meanwhile, the second EBG 51 has a second patch-shaped pattern 52, a connecting portion 53, a linear pattern 54, and a conductive via 55. Compared to the first EBG 41, the second EBG 51 has a differing patch-shaped pattern size. Specifically, whereas the first patch-shaped pattern 42 has a square shape of which the length of one side is reference sign W11 (=W1), the second patch-shaped pattern 52 has a square shape of which the length of one side is reference sign W12 that is shorter than reference sign W11. Aside from the difference in outer size of the patch-shaped patterns, the EBGs 41 and 42 have the same shape. That is, it can be said that a pattern obtained by the first patch-shaped pattern 42 being cut by a predetermined width (W11-W12) over the overall outer periphery is the second patch-shaped pattern 52.

Figure 8:
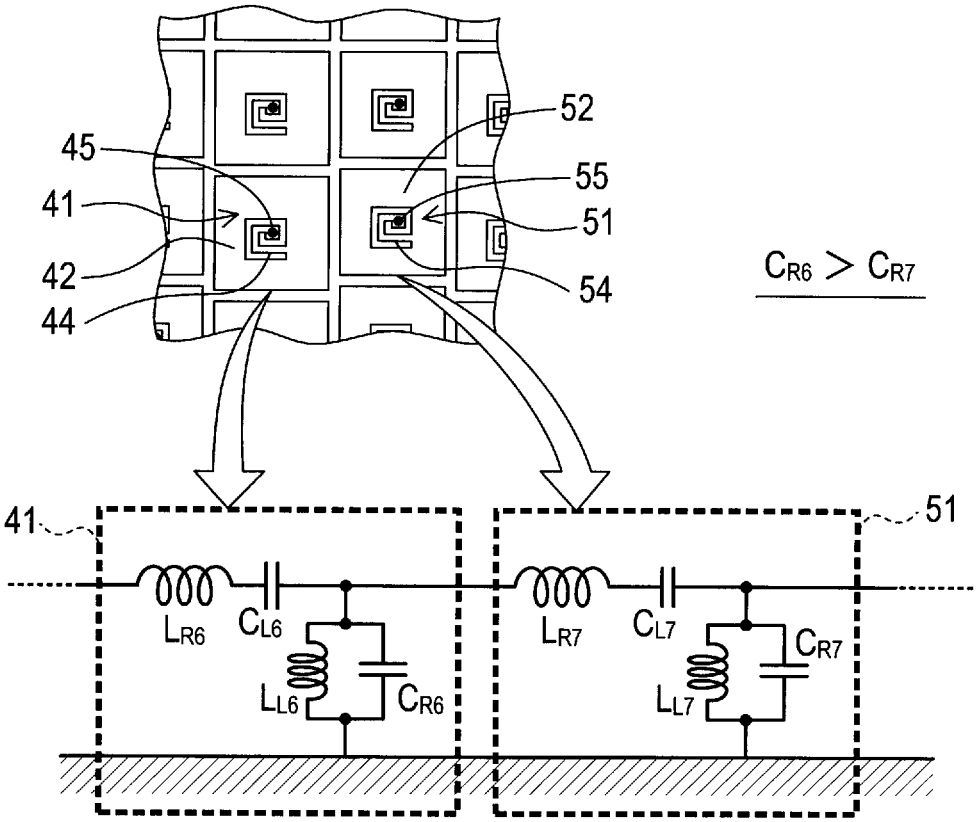
FIG. 8 is an explanatory diagram of equivalent circuits of the surface current suppression filter according to the second embodiment.

The equivalent circuits of the EBGs 41 and 51 according to the present second embodiment are as shown in FIG. 8. Consequently, the cutoff center frequency fc21 of the filter actualized by the first EBG 41 and a cutoff center frequency fc22 of the filter actualized by the second EBG 51 can be respectively expressed by following expressions (4) and (5).

[Formula 3]

$$fc21 = \frac{1}{2\pi\sqrt{L_{L6}C_{R6}}} \tag{4}$$

$$fc22 = \frac{1}{2\pi\sqrt{L_{L7}C_{R7}}} \tag{5}$$

In the equivalent circuits of the EBGs 41 and 51 shown in FIG. 8, respective capacitance components $C_{L6}$ and $C_{L7}$ attributed to capacitance coupling with adjacent EBGs are substantially identical values. In addition, respective inductance components $L_{R6}$ and $L_{R7}$ attributed to the patch-shaped patterns 42 and 52 are also substantially identical values. Furthermore, respective inductance components $L_{L6}$ and $L_{L7}$ attributed to the patch-shaped patterns 42 and 52 are also substantially identical values.

Meanwhile, a capacitance component (hereinafter also referred to as a first inter-ground-plate capacitance) $C_{R6}$ present between the first patch-shaped pattern 42 and the ground plane 3 is generated by the conductive via 45 and the first linear pattern 44. A capacitance component (hereinafter also referred to as a second inter-ground-plate capacitance) $C_{R7}$ present between the second patch-shaped pattern 52 and the ground plane 3 is generated by the conductive via 55 and the second linear pattern 54. Because the sizes differ between the first patch-shaped pattern 42 and the second patch-shaped pattern 52 (that is, the areas differ), the first inter-ground-plate capacitance $C_{R6}$ and the second inter-ground-plate capacitance $C_{R7}$ differ. Specifically, $C_{R6}>C_{R7}$.

Consequently, the first cutoff center frequency fc21 and a second cutoff center frequency fc22 also differ. The first cutoff center frequency fc21 is the cutoff center frequency (resonance frequency) of the first EBG 41. The second cutoff center frequency fc22 is the cutoff center frequency (resonance frequency) of the second EBG 51. That is, fc21<fc22. The differences in the cutoff characteristics between the EBGs 41 and 51 are mainly actualized by the areas of the patch-shaped patterns 42 and 52 configuring the EBGs 41 and 51 being set to differ.

Therefore, the cutoff center frequencies fc21 and fc22 of the EBGs 41 and 51 are appropriately set based on the center frequency fa of the surface current to be cut off. Then, the EBGs 41 and 51 are configured such that the cutoff center frequencies fc21 and fc22 that have been set are actualized. As a result, the surface current suppression filter 30 having a wide stopband can be actualized.

The cutoff characteristics diagram in FIG. 5 that is described according to the first embodiment also shows an example of the cutoff characteristics of the surface current suppression filter 30 according to the present second embodiment. As shown in the example in FIG. 5, the stopband of the surface current suppression filter 30 according to the present second embodiment is approximately 1.5 GHz wide. Therefore, the stopband of the surface current suppression filter 30 according to the present second embodiment actualizes a wider band than that of the surface current suppression filter having the comparative structure.

As a result of the surface current suppression filter 30 according to the present second embodiment described above, a wide band in which the stopband of the first EBG 41 (a predetermined band including the first cutoff center frequency fc21) and the stopband of the second EBG 52 (a predetermined band including the second cutoff center frequency fc22) are combined is achieved. Therefore, in a manner similar to that according to the first embodiment, propagation of the surface current over the dielectric substrate 2 (in particular, propagation in the array direction) can be effectively blocked.

In particular, according to the present second embodiment, the difference in cutoff characteristics between the EBGs 41 and 51 is actualized by the outer sizes of the patch-shaped patterns formed on the substrate front surface being made to differ (that is, the areas of the patch-shaped patterns being made to differ). Therefore, a plurality of types (two types according to the present embodiment) of EBGs 41 and 51 having differing cutoff characteristics can be easily formed. Furthermore, the surface current suppression filter 30 can be easily and inexpensively actualized.

[Third Embodiment]

An antenna apparatus of the present invention will be described in detail with reference to FIG. 9.

In the description according to the third embodiment, configurations that are shared with the surface current suppression filter according to the first or second embodiment described above are given the same reference signs.

Figure 9:
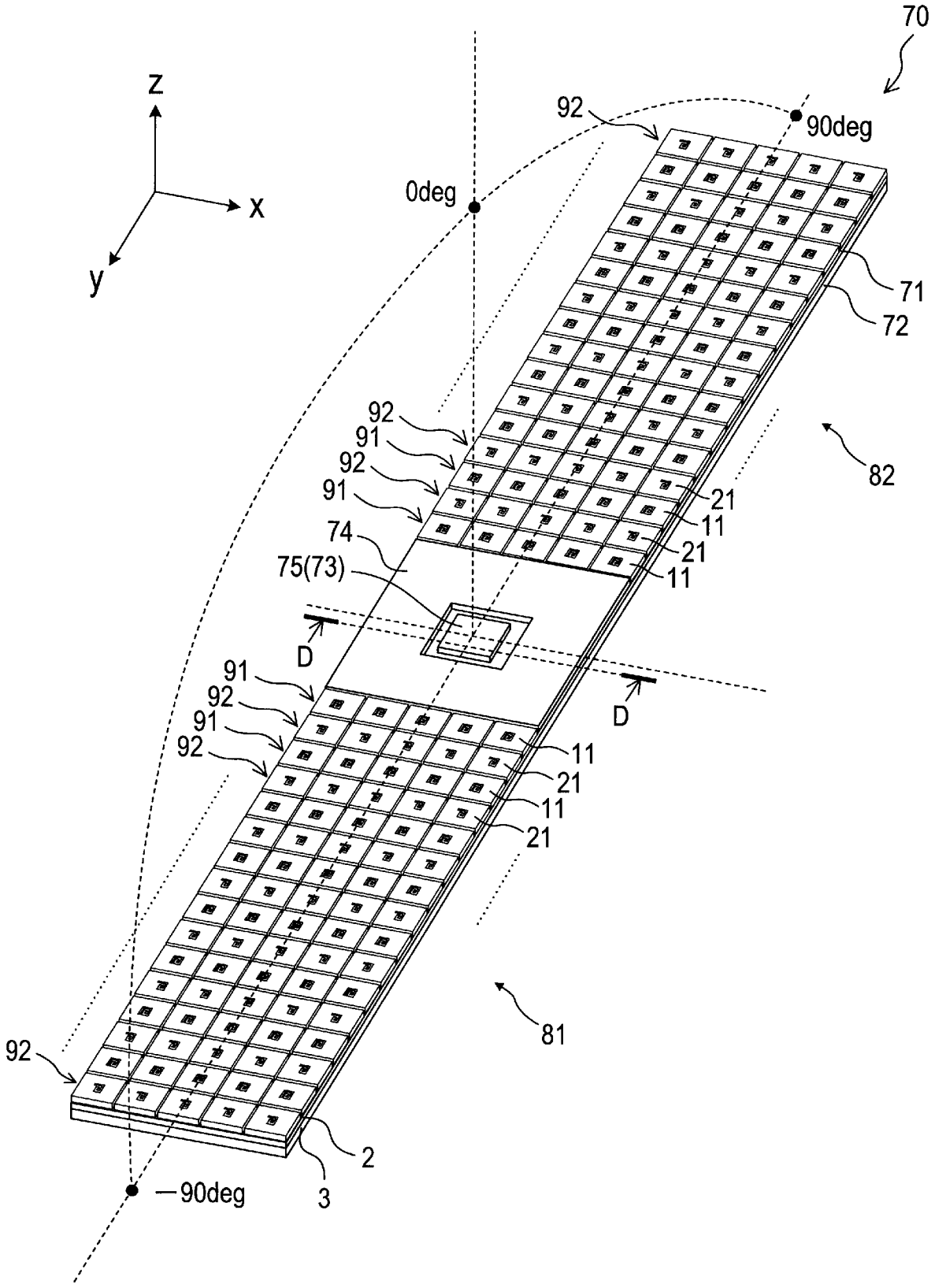
FIG. 9 is a perspective view of an antenna apparatus according to a third embodiment.

As shown in FIG. 9, in an antenna apparatus 70 according to the present third embodiment, a ground plane 72 is formed on one surface (substrate back surface) of a dielectric substrate 71. The dielectric substrate 71 has a rectangular shape. The ground plane 72 is composed of a conductor. In addition, in the antenna apparatus 70 according to the present third embodiment, a patch antenna 73, a conductor plate 74, and a plurality of EBGs 11 and 21 are formed on the other surface (substrate front surface) of the rectangular dielectric substrate 71. According to the present third embodiment, as shown in FIG. 9, the description will be given using, as appropriate, xyz three-dimensional coordinate axes in which, with the center portion of the patch antenna 73 (center portion of a patch radiating element 75 described hereafter) as a point of origin, an axis that passes through the point of origin and is parallel to the short side of the dielectric substrate 71 is an x axis, an axis that passes through the point of origin and is parallel to the long side of the dielectric substrate 71 is a y axis, and an axis that passes through the point of origin and is perpendicular to the plate surface of the dielectric substrate 71 is a z axis.

The patch antenna 73 has a square-shaped patch radiating element 75. The patch radiating element 75 is formed in the center portion of the substrate front surface. The ground plane 72 on the substrate back surface functions as a ground plane for the patch radiating element 75. The square-shaped patch radiating element 75 is arranged such that a set of opposing sides are parallel in the x-axis direction, and a set of opposing sides are parallel in the y-axis direction.

Figure 10:
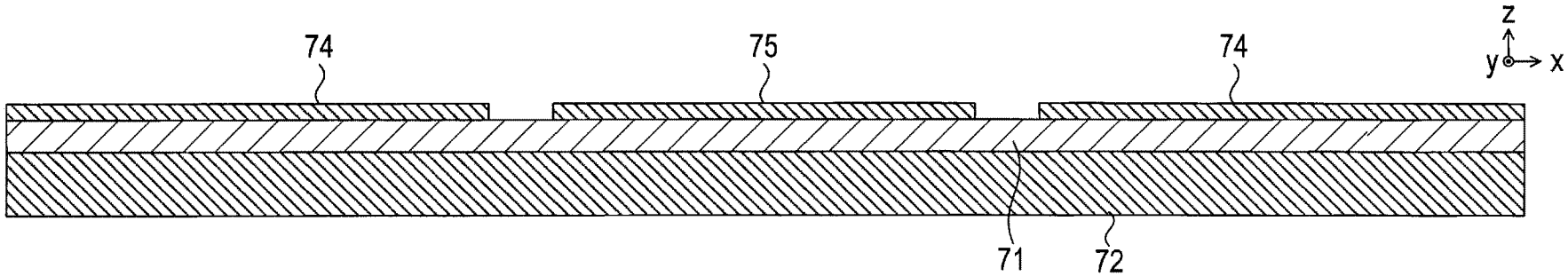
FIG. 10 is a cross-sectional view (cross-section taken along D-D) of the antenna apparatus according to the third embodiment.

As is clear from FIGS. 9 and 10, the conductor plate 74 is formed in the periphery of the patch radiating element 75. However, a groove is formed between the patch radiating element 75 and the conductor plate 74 over the overall periphery of the patch radiating element 75. In addition, as a result of the groove, the patch radiating element 75 is physically separated from the conductor plate 74.

In addition, the length of one side of the patch radiating element 75 is about $\lambda/2$. Here, $\lambda g$ is a wavelength (however, a dielectric material inner wavelength) corresponding to an operation frequency of the patch antenna 73. However, the length of about $\lambda/2$ is an example. For example, the optimal length changes depending on various factors such as the shape and size of the ground plane 72.

Power supply to the patch antenna 73 is performed through the patch radiating element 75. However, the structure for power supply to the patch radiating element 75 is not shown in the drawings. Various methods for supplying power to a patch-shaped radiating element have been considered and put to actual use. Therefore, a detailed description is omitted. However, according to the present embodiment, the structure is such that power supply is performed by an electromagnetic coupling type power supply method from a microstrip line for power supply.

The patch antenna 73 operates with the y-axis direction as a main polarization direction (E-plane direction). That is, the patch antenna 73 operates with a yz plane as a polarization plane (E-plane), and is configured as an antenna that can favorably transmit and receive polarized waves on this yz plane.

The antenna apparatus 70 is disposed in, for example, the front of a vehicle such that the substrate front surface side on which the patch antenna 73 is formed faces ahead of the vehicle and the long side of the rectangular dielectric substrate 71 (the side in the y-axis direction) is horizontal in relation to the ground surface. The antenna apparatus 70 is used, for example, as a millimeter wave radar for monitoring the periphery of a vehicle. That is, when used so as to be mounted in a vehicle, the E-plane of the patch antenna 73 is parallel in relation to the ground surface. Therefore, the patch antenna 73 is used as an antenna that can favorably transmit and receive horizontal polarized waves.

In the present specification, as shown in FIG. 9, an azimuth angle (detection angle) on the horizontal plane (E-plane) of the patch antenna 73 is such that, with reference to the z-axis direction (0°), the left-hand side when the direction ahead of the vehicle is viewed from the patch antenna 73 is considered a positive angle and the right-hand side is considered a negative angle.

On the substrate front surface of the dielectric substrate 71, a first filter 81 and a second filter 82 are respectively formed between the patch antenna 73 and both substrate ends (specifically, between the conductor plate 74 in the periphery of the patch antenna 73 and both substrate ends).

Specifically, the first filter 81 is formed on the negative azimuth angle side when viewed from the patch antenna 73. In addition, the second filter 82 is formed on the positive azimuth angle side when viewed from the patch antenna 73.

The first filter 81 is configured such that first EBG rows 91 and second EBG rows 92 are alternately arrayed in the y-axis direction from the patch antenna 73 side towards the substrate end portion. The first EBG row 91 is composed of a plurality (five according to the present third embodiment) of first EBGs 11 arrayed in the x-axis direction. The first EBG 11 has a configuration that is completely identical to that of the first EBG 11 according to the first embodiment and therefore has the same reference sign as that according to the first embodiment. The second EBG row 92 is composed of a plurality (five according to the present third embodiment) of second EBG 21 arrayed in the x-axis direction. The second EBG 21 has a configuration that is completely identical to that of the second EBG 21 according to the second embodiment and therefore has the same reference sign as that according to the first embodiment. Compared to the surface current suppression filter 1 according to the first embodiment, the first filter 81 differs in terms of the numbers of EBG rows 91 and 92 that are arrayed and the numbers of EBGs 11 and 21 configuring the EBG rows 91 and 92.

However, the main configurations for achieving the functions of the filter, such as the EBG rows 91 and 92 being alternately arrayed in the E-plane direction and the EBG rows 91 and 92 each being composed of a plurality of EBGs arrayed in the x-axis direction, are basically the same as those of the surface current suppression filter 1 according to the first embodiment. Therefore, the first filter 81 has a surface current cutoff performance equivalent to that of the surface current suppression filter 1 according to the first embodiment.

That is, according to the present third embodiment, when the patch antenna 73 is operated and radio waves are radiated, a surface current having a center frequency fa flows from the patch antenna 73 towards both substrate ends. The first filter 81 effectively suppresses propagation of surface current towards the end portion on the negative azimuth angle side in the E-plane direction, among the surface current having the center frequency fa.

The second filter 82 has the same configuration as the first filter 81. That is, when the first filter 81 is moved by line-symmetric displacement with a straight line passing through the center of the patch antenna 73 and parallel to the x-axis as the axis of symmetry, the second filter 82 is obtained. In other words, the first filter 81 and the second filter 82 have an arrangement relationship of line-symmetry to each other in relation to the axis of symmetry.

Therefore, the second filter 82 also has the surface current cutoff performance equivalent to that of the surface current suppression filter 1 according to the first embodiment. That is, the second filter 82 effectively suppresses propagation of surface current towards the end portion on the positive azimuth angle side in the E-plane direction, among the surface current having the center frequency fa that flows from the patch antenna 73 to the substrate end portion during operation of the patch antenna 73.

Examples of E-plane directional gain of an antenna apparatus (hereinafter referred to as a comparative antenna apparatus) in which the filter having the comparative structure shown in FIG. 4(*a*) is mounted as the surface current suppression filters provided on both ends of the patch antenna 73, and the antenna apparatus 70 according to the present third embodiment will be described with reference to FIG. 11. In both antenna apparatuses, the filters mounted therein are designed so as to be capable of appropriately cutting off a current of at least the frequency component 24 GHz. For example, the filters mounted in the comparative antenna are designed such that the cutoff center frequency is 24 GHz. In addition, the filters 81 and 82 mounted in the antenna apparatus 70 according to the present third embodiment are designed such that the vicinity of the center of the wide stopband actualized by the two types EBG rows 91 and 92 is 24 GHz wide.

Figure 11:
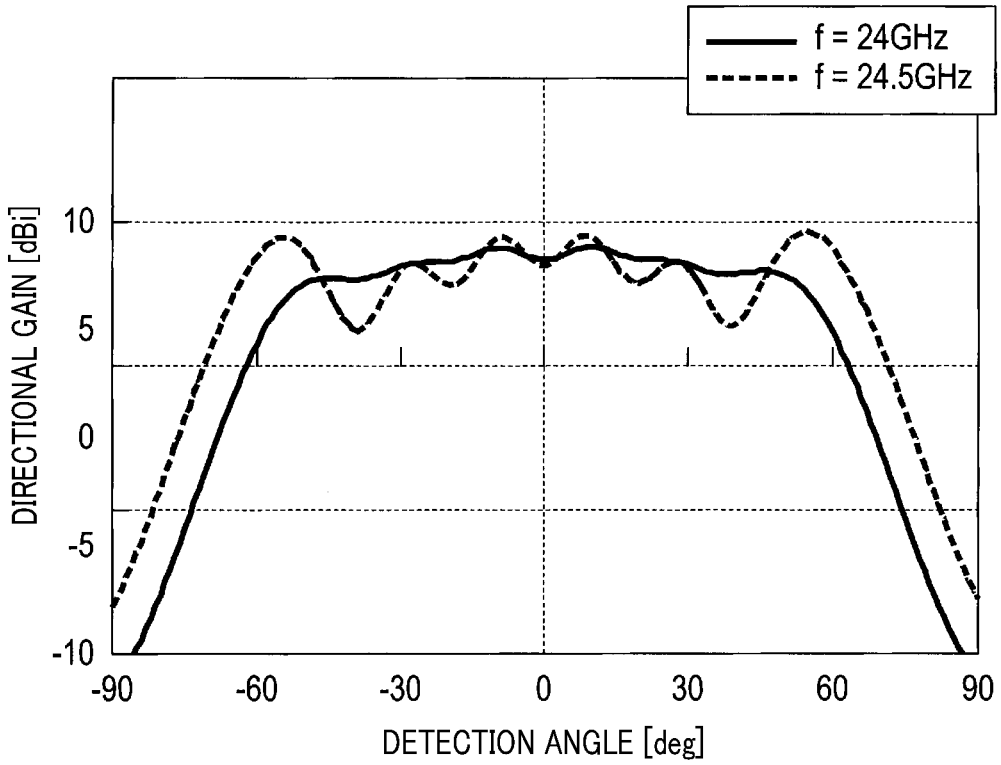
FIG. 11 is an explanatory diagram of both directional gain of the antenna apparatus according to the third embodiment and directional gain of an antenna apparatus having a comparative structure.
Figure 11:
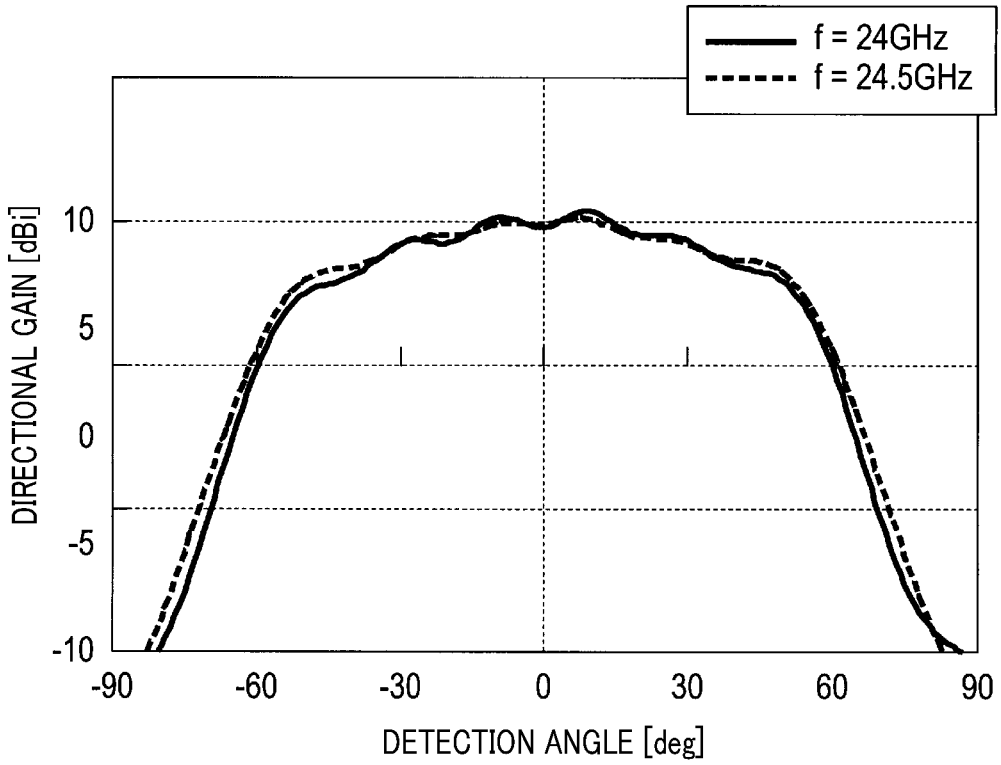

Therefore, in both the comparative antenna apparatus and the antenna apparatus 70 according to the present embodiment, when radio waves of 24 GHz are emitted, partial drops (ripples) in directivity hardly occur, as indicated by solid lines in FIG. 11. From a strict perspective, partial drops (ripples) in directivity slightly occur but at a level that can be ignored.

Meanwhile, when the center frequency of the radio waves emitted from the antenna apparatus 70 is 24.5 GHz, in the case of the comparative antenna apparatus, because 24.5 GHz is not included in the stopband of the filters, the surface current of 24.5 GHz cannot be suppressed. Therefore, a large portion of the surface current of which the center frequency fa is 24.5 GHz propagates to the substrate end portions. Consequently, as indicated by the broken line in FIG. 11 by (a), ripples occur in directivity over a wide angular range. In particular, the ripples are large near ±45°.

That is, in the comparative antenna apparatus, when the center frequency of the surface current shifts from the cutoff center frequency of the filter, suppression of surface current tends to become difficult. A reason for this is that, in the comparative antenna apparatus, the stopband of the filter is narrow. Conversely, when the actual cutoff center frequency of the filter shifts from the center frequency of the surface current, suppression of the surface current tends to become difficult. That is, as a result of various factors such as manufacturing tolerance, the actual cutoff center frequency of the filter formed on the substrate does not necessarily match the design value at all times. In fact, in most cases, the actual cutoff center frequency deviates from the design value. For example, even should the cutoff center frequency be 24 GHz in terms of design, the cutoff center frequency of the filter that is actually formed may be 24.5 GHz. In such cases, in the comparative antenna apparatus, the surface current may not be able to be suppressed. That is, the filters mounted in the comparative antenna have a narrow stopband, and a wide band for the surface current that can be suppressed cannot be obtained. Furthermore, the allowable range regarding deviation of the cutoff center frequency from the design value occurring as a result of manufacturing tolerance and the like of the filter is also narrow.

In this regard, in the antenna apparatus 70 according to the present third embodiment, the first filter 81 and the second filter 82 that have wide stopbands are mounted. Therefore, as indicated by the broken line in FIG. 11(*b*), even should the center frequency of the radio waves emitted from the antenna apparatus 70 be 24.5 GHz, ripples in directivity hardly occur.

That is, the stopbands of the filters 81 and 82 mounted in the antenna apparatus 70 according to the present third embodiment are wide, and the band of the surface current that can be suppressed can be set to be wide. Furthermore, in the filters 81 and 82 mounted in the antenna apparatus 70 according to the present third embodiment, the allowable range regarding deviation of the cutoff center frequency from the design value occurring as a result of manufacturing tolerance and the like of the filter is also wide. Therefore, propagation of the surface current can be suppressed over a wide band. In addition, even should the actual cutoff center frequencies of the filters 81 and 82 deviate from the design values, cutoff performance regarding surface current can be maintained. Consequently, as shown in the example in FIG. 11 by (b), ripples in directional gain can be sufficiently reduced over a wide band. Furthermore, even should the center frequency fa of the surface current deviate from the design value (conversely, even should the stopbands of the filters 81 and 82 deviate from the design values as a result of manufacturing tolerance and the like), the effect of reducing ripples is sufficiently maintained.

[Other Embodiments]

Embodiments of the present invention are described above. However, the present invention is not limited to the above-described embodiments and various aspects are possible.

(1) As a specific method for making the cutoff characteristics differ among the plurality of types of EBGs configuring the above-described surface current suppression filter, according to the first embodiment, a method in which the lengths of the linear patterns are set to differ is used. In addition, as a specific method for making the cutoff characteristics differ among the plurality of types of EBGs configuring the above-described surface current suppression filter, according to the second embodiment, a method in which the sizes of the patch-shaped patterns are set to differ is used. However, these methods are merely examples.

Figure 12:
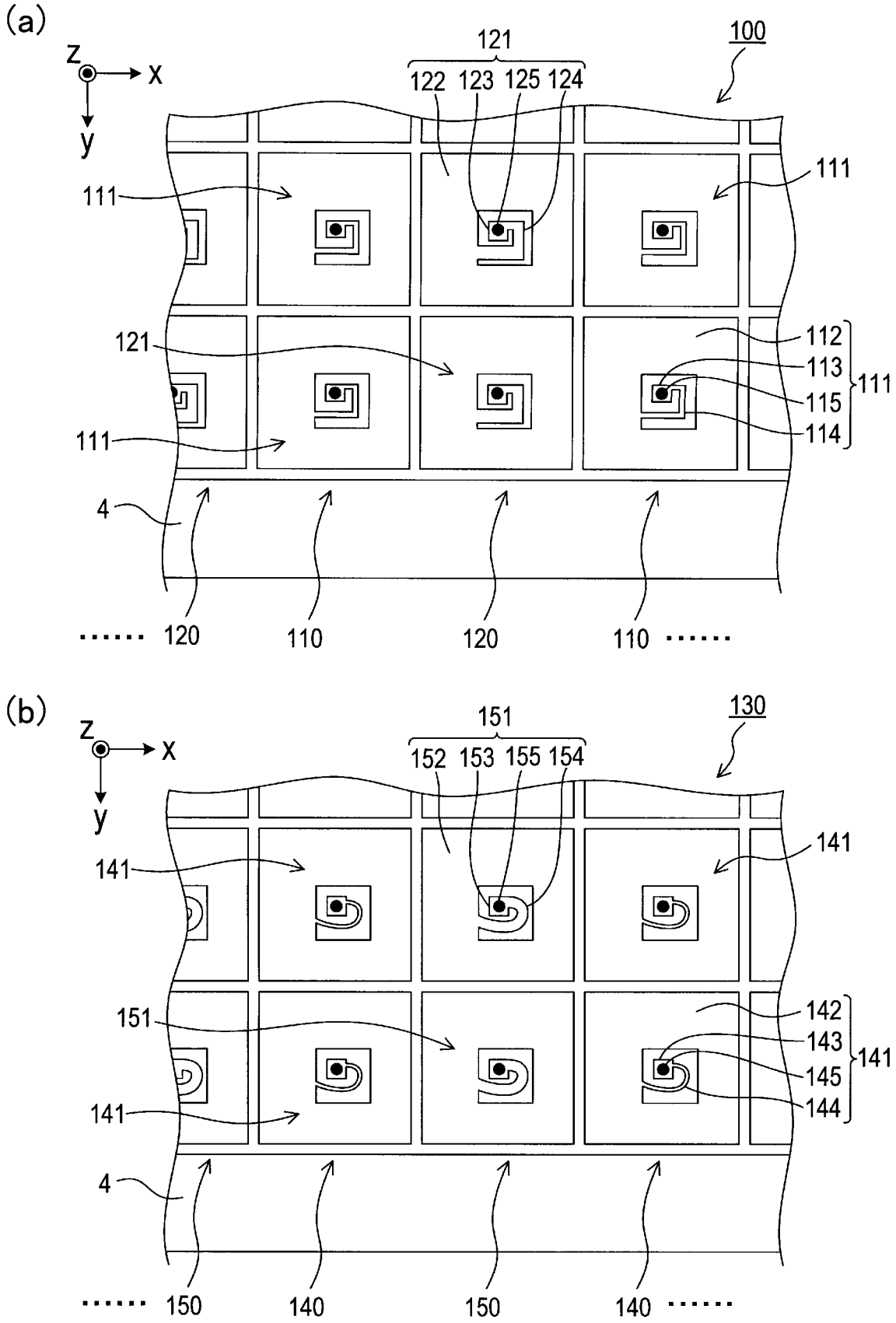
FIG. 12 is partial top views of two other variation examples of the surface current suppression filter.

For example, the widths (thicknesses) of the linear patterns may be set to differ, while the lengths are the same. An example of the surface current suppression filter using two types of EBGs of which the widths of the linear patterns differ is shown in FIG. 12 by (a). In a surface current suppression filter 100 shown in FIG. 12 by (a), first EBG rows 110 and second EBG rows 120 are alternately arrayed in a predetermined array direction (x-axis direction). The first EBG row 110 is composed of a plurality of first EBG rows 111 arrayed in the Y-axis direction. In addition, the second EBG row 120 is composed of a plurality of second EBG rows 121 arrayed in the y-axis direction.

The EBGs 111 and 121 each have a shape in which the first EBG 11 according to the first embodiment shown in FIG. 2 is flipped horizontally (however, the widths of the linear patterns differ). The difference between the EBGs 111 and 121 is the width of the linear pattern. That is, the width of a linear pattern 114 of the first EBG 111 is narrower than the width of a linear pattern 124 of the second EBG 121. As a result of the widths of the linear patterns being set to differ, the cutoff characteristics (cutoff center frequencies and stopbands) of the EBGs 111 and 121 differ. In addition, the stopband of the overall surface current suppression filter 100 is a wide band that is the total of the stopbands of both EBGs 111 and 121.

(2) The shape of the linear pattern is not limited to a linear shape. For example, as shown as an example in FIG. 12 by (b), the shape of the linear pattern may be a curved shape. Only a portion of the overall length of the linear pattern may be a curve. Alternatively, the linear pattern may be formed into a curve over the overall length.

In a surface current suppression filter 130 shown in FIG. 12 by (b), first EBG rows 140 and second EBG rows 150 are alternately arrayed in a predetermined array direction (x-axis direction). The first EBG row 140 is composed of a plurality of first EBGs 141 arrayed in the y-axis direction. The second EBG row 150 is composed of a plurality of second EBGs 151 arrayed in the y-axis direction.

The first EBG 141 is that in which the linear pattern 114 of the first EBG 111 in FIG. 12 by (a) is formed into a curve. The second EBG 151 is that in which the linear pattern 124 of the second EBG 121 in FIG. 12 by (a) is formed into a curve. The surface current suppression filter 130 in FIG. 12 by (b) configured in this manner also has cutoff characteristics equivalent to those of the surface current suppression filter 100 in FIG. 12 by (a).

(3) The shapes of the overall conductor portions on the substrate front surfaces configuring the EBGs may be set to differ (and as a result, making the cutoff characteristics of the EBGs differ) by other various methods. For example, differences in cutoff characteristics may be actualized by the outer shapes of the conductive vias being set to differ.

(4) According to the above-described embodiments, as a specific example in which the cutoff characteristics of the EBGs differ, an example in which the resonance frequencies (cutoff center frequencies) differ is given. However, according to the above-described embodiments, as long as the cutoff characteristics of the EBGs differ, various aspects are possible. For example, an aspect may be such that, while the resonance frequencies fc are the same, the stopbands (the frequency bands that can be suppressed to a predetermined level below a pass level or lower) differ (however, one may partially or entirely overlap with the other). Of course, the resonance frequencies fc may differ, and the stopband width may also differ. As long as the cutoff performance (the effect of suppressing the surface current) can be improved as a result, compared to when all of the EBGs have the same cutoff characteristics, the types of cutoff performances of the EBGs formed as the two differing types of EBGs can be appropriately determined.

(5) The number of EBGs configuring one EBG row can be appropriately determined. One EBG row may be composed of one EBG. Not all EBG rows are required to have the same number of EBGs. The number of EBGs may differ for each EBG row. The arrangement spacing of the plurality of EBGs when the EBG row has a plurality of EBGs can be appropriately determined. The arrangement spacing of the plurality of EBGs within an EBG row is not necessarily required to be an even spacing.

The number of EBG rows arrayed in the E-plane direction is merely required to be at least two rows or more. Three or more types of EBG rows having differing cutoff characteristics may be arrayed in the E-plane direction. The sequence by which the plurality of types of EBG rows are arrayed in the E-plane direction can be appropriately determined. The plurality of types of EBG rows being alternately arrayed as according to the above-described embodiments is not a requisite. All that is required is that at least one EBG row among the plurality of EBG rows arrayed in the E-plane direction (array direction) have differing cutoff characteristics from the other EBG rows. In other words, all that is required is that at least one EBG row among the plurality of EBG rows is such that the cutoff characteristics of the EBGs in the EBG row differ from the cutoff characteristics of the EBGs in the other EBG rows.

The arrangement spacing (spacing in the E-plane direction) between adjacent EBG rows can be appropriately determined. In addition, a relative positional relationship between adjacent EBG rows in a direction perpendicular to the array direction can be appropriately determined.

(7) The outer shape of the patch-shaped pattern configuring the EBG may not be a square. For example, the outer shape may be a circle. Alternatively, at least a portion of the outer periphery may be a curve. Alternatively, the outer shape may be a polygon other than a square. Regarding the cross-sectional shape of the conductive via as well, the cross-sectional shape being a circle is merely an example and may be a cross-sectional shape other than a circle. In addition, a plurality of conductive vias may be used in one EBG.

(8) As the surface current suppression filter mounted in the antenna apparatus 70 according to the third embodiment, the surface current suppression filters according to various aspects in which the present invention is applied can be used. For example, the surface current suppression filter 30 according to the second embodiment shown in the example in FIG. 6 may be used. In addition, either of the two types of surface current suppression filters 100 and 130 shown in the examples in FIG. 12 may be used. In addition, the filter on one end portion side, when viewed from the patch antenna 73, and the filter on the other end portion side may be differing types of filters.

(9) In the antenna apparatus 70 according to the third embodiment, arrangement of the patch antenna 73 in the center portion of the substrate is not a requisite. Filters are not required to be provided on both substrate end sides, when viewed from the patch antenna 73. The filter may be provided on only either end portion side.

(10) A function provided by one constituent element according to the above-described embodiments may be dispersed as a plurality of constituent elements. Functions provided by a plurality of constituent elements according to the above-described embodiments may be integrated in one constituent element. Furthermore, at least a part of a configuration according to the above-described embodiments may be replaced by a publicly known configuration having a similar function. In addition, a part of a configuration according to the above-described embodiments may be omitted. Furthermore, at least a part of a configuration according to an above-described embodiment may be added to or replace a configuration according to another above-described embodiment. All aspects included in the technical concept identified solely by the expressions recited in the claims are embodiments of the present invention.

REFERENCE SIGNS LIST

1, 30, 100, 130: surface current suppression filter
2, 71: dielectric substrate
3, 72: ground plane
4, 31, 74: conductor plate
10, 40, 91, 110, 140: first EBG row
11, 41, 111, 141: first EBG
12, 42, 112, 142: first patch-shaped pattern
13, 23, 43, 53, 113, 123, 143, 153: connecting portion
14, 44, 114, 144: first linear pattern
15, 25, 45, 55, 115, 125, 145, 155: conductive via
20, 50, 92, 120, 150: second EBG row
21, 51, 121, 151: second EBG
22, 52, 122, 152: second patch-shaped pattern

24, 54, 124, 154: second linear pattern
70: antenna apparatus
73: patch antenna
75: patch radiating element
81: first filter
82: second filter

The invention claimed is:

1. A surface current suppression filter that is a bandstop filter that suppresses propagation of a surface current in a predetermined propagation direction on a dielectric substrate in which a conductor plate is formed on one plate surface, the surface current suppression filter comprising:

a plurality of conductive structures provided on the dielectric substrate, each of the plurality of conductive structures including a patch conductor portion that is a patch-shaped conductor formed on the other plate surface of the dielectric substrate, and a connecting conductor that is formed between the patch conductor portion and the conductor plate so as to pass through the dielectric substrate to electrically connect the patch conductor portion and the conductor plate, a plurality of structure rows being arrayed in the propagation direction, each of the plurality of structure rows including at least one conductive structure arrayed in a perpendicular direction orthogonal to the propagation direction, cutoff characteristics of the surface current of the at least one conductive structure in at least one structure row of the plurality of structure rows differing from cutoff characteristics of the at least one conductive structure in at least one other structure row of the plurality of structure rows, wherein the patch conductor portion includes a patch-shaped pattern having a predetermined shape, and a linear pattern that connects the patch-shaped pattern and the connecting conductor, and the difference in cutoff characteristics between the plurality of conductive structures is configured by setting widths of the linear patterns configuring the plurality of conductive structures to differ, while lengths of the linear patterns are the same.

2. The surface current suppression filter according to claim 1, wherein:

the linear pattern is such that at least a portion of an overall length is formed into a curved shape.

3. The surface current suppression filter according to claim 1, wherein:

the differing cutoff characteristics are cutoff center frequencies.

4. The surface current suppression filter according to claim 3, wherein:

cutoff center frequency of the at least one conductive structure in each of the plurality of structure rows is set to either of a first cutoff center frequency and a second cutoff center frequency.

5. The surface current suppression filter according to claim 4, wherein:

the structure row having the conductive structure having the first cutoff center frequency and the structure row having the conductive structure having the second cutoff center frequency are alternately arrayed in the propagation direction.

6. An antenna apparatus comprising:

a dielectric substrate in which a ground plane is formed on one plate surface;

a patch antenna that has at least one patch radiating element for power supply formed on the other plate surface of the dielectric substrate and of which a predetermined direction on the plate surface of the dielectric substrate is a main polarized wave direction; and a surface current suppression filter that is provided between at least one end portion of both end portions of the dielectric substrate in the main polarized wave direction and the patch antenna, and that is a bandstop filter that suppresses propagation of a surface current from the patch antenna to the end portion on the dielectric substrate, the surface current suppression filter including a plurality of conductive structures provided on the dielectric substrate, each of the plurality of conductive structures including a patch conductor portion that is a patch-shaped conductor formed on the other plate surface of the dielectric substrate, and a connecting conductor that is formed between the patch conductor portion and the ground plane so as to pass through the dielectric substrate to electrically connect the patch conductor portion and the ground plane, a plurality of structure rows being arrayed in the main polarized wave direction, each of the plurality of structure rows including at least one conductive structure arrayed in a perpendicular direction orthogonal to the main polarized wave direction, cutoff characteristics of the surface current of the at least one conductive structure in at least one structure row of the plurality of structure rows differing from cutoff characteristics of the at least one conductive structure in at least one other structure row of the plurality of structure rows, wherein the patch conductor portion includes a patch-shaped pattern having a predetermined shape, and a linear pattern that connects the patch-shaped pattern and the connecting conductor, and the difference in cutoff characteristics between the plurality of conductive structures is configured by setting widths of the linear patterns configuring the plurality of conductive structures to differ, while lengths of the linear patterns are the same.

* * * * *